US006578822B2

(12) United States Patent
Heun et al.

(10) Patent No.: US 6,578,822 B2
(45) Date of Patent: Jun. 17, 2003

(54) DEVICE FOR LIMITING THE UPPER ROTATION SPEED OF A BALANCING HOIST

(75) Inventors: Jorgen Heun, Dortmund (DE); Markus Lobel, Witten (DE); Klaus-Jürgen Winter, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 103 days.

(21) Appl. No.: 09/804,841

(22) Filed: Mar. 13, 2001

(65) Prior Publication Data

US 2001/0022358 A1 Sep. 20, 2001

(30) Foreign Application Priority Data

Mar. 17, 2000 (DE) ..... 100 14 910

(51) Int. Cl.[7] ..... B66D 1/00
(52) U.S. Cl. ..... 254/331; 254/360
(58) Field of Search ..... 254/267, 268, 254/329, 331, 360, 378

(56) References Cited

U.S. PATENT DOCUMENTS 2,896,912 A * 7/1959 Faugier et al. ..... 182/237
3,526,388 A * 9/1970 Geiger et al. ..... 137/625
5,439,200 A 8/1995 Braesch et al.
5,522,581 A 6/1996 Kulhavy
5,553,832 A 9/1996 Zaguroli, Jr.
5,556,077 A 9/1996 Braesch et al.
5,593,138 A * 1/1997 Zaguroli, Jr. ..... 254/288
5,848,781 A * 12/1998 Kulhavy et al. ..... 188/170
6,155,538 A * 12/2000 Winter ..... 254/331

* cited by examiner

*Primary Examiner*—Emmanuel Marcelo
(74) *Attorney, Agent, or Firm*—Henry M. Feiereisen

(57) ABSTRACT

A balancing hoist, includes a housing having a chamber accessible from outside. Received in the housing is a piston which is movable by gas pressure in a longitudinal direction and rotates a threaded spindle which projects into the chamber of the housing and carries a nut that securely fixed to the housing. Mounted in fixed rotative engagement to the spindle and movable longitudinally along the spindle is a cable drum on which a load-carrying cable is wound. At least one pawl is provided and configured for rotation in opposition to an elastic restraining force from a radially inward idle position to a radially outward brake position as a result of centrifugal forces, when a rotation speed of the cable drum exceeds a predetermined level, thereby impacting upon a fixed stopper which projects radially inwardly from the housing and slowing down the rotation of the cable drum until it is at rest.

24 Claims, 2 Drawing Sheets

DEVICE FOR LIMITING THE UPPER ROTATION SPEED OF A BALANCING HOIST

CROSS-REFERENCES TO RELATED APPLICATIONS

This application claims the priority of German Patent Application Serial No. 100 14 910.3, filed Mar. 17, 2000, the subject matter of which is incorporated herein by reference.

BACKGROUND OF THE INVENTION

The present invention relates, in general, to a balancing hoist, and more particularly to a safety device for limiting the upper rotation speed of a balancing hoist.

Balancing hoists are known in many configurations. Examples include U.S. Pat. Nos. 5,553,832, 5,522,581, 5,556,077, and 5,439,200, The hoists described therein translate an axial movement of a hollow piston into a rotation of a cable drum or chain drum or chain sprocket. This conversion is implemented by a ball screw which carries a nut. Depending on the design, the ball screw may either be securely fixed to a housing while the nut is moved together with the cable drum along the spindle, or the nut is secured against axial displacement and allowed to rotate so that the ball screw is moved axially and prevented from rotating. Conventional hoists have a safety device in the form of several pawls which can rotate about a pivot axis in parallel relationship to the ball screw between a radially inward idle position and a radially outward brake position. Rotation of the pawls is realized in opposition to a spring force that tends to bias the pawls to seek the idle position. During rotation of the cable drum, the pawls point with their free end in rotation direction. As a consequence of the biasing restraining force of the spring, the pawls pivot into the brake position with their free end under the influence of centrifugal forces only when the cable drum reaches a predetermined rotation speed. In the brake position, the pawls are abruptly wedged into the stationary housing to thereby instantly stop the rotation of the drum or the chain sprocket with which the pawls are positively connected.

These conventional hoists suffer many shortcomings. As the pawls are driven abruptly into the housing, they are subject to impact stress as is also the attached assembly. The extent of this stress cannot be influenced. Thus, the related components may deform or break so that the attached assemblies and/or the hoist become useless. Therefore, once the safety device is triggered and damage is encountered, a performance test must be carried out and individual components must be replaced, if necessary. In these conventional balancing hoists, the performance test as well as the replacement of components of the safety device require a complicated disassembly during which the hoist must also be detached from the suspension.

It would therefore be desirable and advantageous to provide an improved hoist which obviates prior art shortcomings and to provide an improved a safety device which is simple in structure and allows simple replacement of components while yet being reliable in operation.

SUMMARY OF THE INVENTION

According to one aspect of the present invention, a balancing hoist includes a housing having a chamber accessible from outside, a piston movable by gas pressure in the housing in a longitudinal direction, a threaded spindle caused to rotate as the piston moves in the longitudinal direction, and carrying a nut which is securely fixed to the housing, a cable drum mounted in fixed rotative engagement to the spindle and movable longitudinally along the spindle, at least one pawl configured for rotation in opposition to an elastic restraining force between a radially inward idle position and a radially outward brake position about a pivot pin, which extends in parallel relationship to the spindle, with the pawl pointing in rotation direction at rotating cable drum and pivoting into the brake position as a result of centrifugal forces, when a rotation speed of the cable drum exceeds a predetermined level which is dependent on the magnitude of the restraining force, and at least one fixed stopper projecting radially inwardly from the housing at a level with the brake position for interaction with the pawl, when the pawl is in the brake position, for braking the rotation of the cable drum until its standstill, wherein the spindle has one end projecting into the chamber of the housing for connection to the pivot pin.

The present invention resolves prior art problems by providing a housing chamber which is accessible from outside and suitably closed by a cover, and in which the end of the threaded spindle projects for support of a braking mechanism which prevents the spindle from rotating beyond a predetermined rotation speed. This braking mechanism is in frictional engagement with the spindle so as to implement a gradual braking action of the spindle and thus of the cable drum. The stopper is stationary and projects inwardly from the housing wall into the travel path of the pawl, when the pawl is moved radially outwards into the brake position under the action of centrifugal force. Through arrangement of the braking mechanism in a separate housing chamber, which is easily accessible through detachment of the cover, operativeness can easily be checked and replacement of components, if necessary, is simple to carry out, without requiring a detachment of the hoist from a suspension.

According to another feature of the present invention, the stopper may be provided as an enlargement of the housing wall, with the enlargement projecting inwardly into the chamber.

According to another feature of the present invention, the frictional engagement of the braking mechanism with the spindle can be realized by fixedly securing an inner cone to the spindle, and by placing a complementary outer cone placed over the inner cone, whereby the pivot pin of the pawl is mounted to the outer cone. Thus, when the rotation of the cable drum exceeds the predetermined rotation speed, the centrifugal force acting on the pawl causes the pawl to impact upon the stopper to thereby gradually slow down the rotation of the outer cone and ultimately bring the spindle and the cable drum to rest, as a consequence of the frictional engagement between the inner cone and the outer cone. Suitably, the inner cone and the outer cone are braced together by a screw fastener

BRIEF DESCRIPTION OF THE DRAWING

Other features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
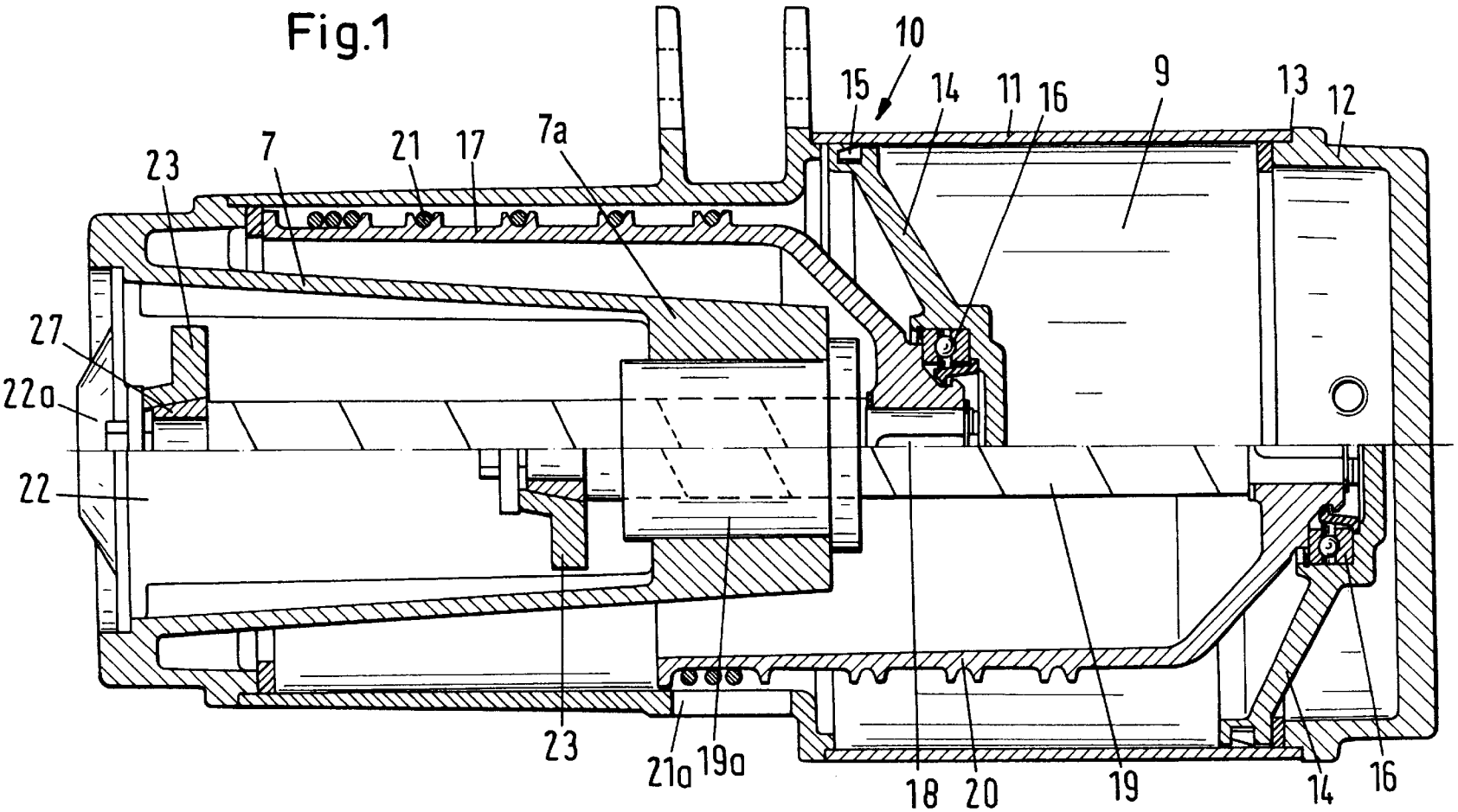
FIG. 1 is a longitudinal section of a balancing hoist incorporating a safety device according to the present invention, with the upper half illustrating a cable drum and piston in one end position, and with the lower half illustrating the rope drum and the piston in another end position.

Throughout all the Figures, same or corresponding elements are generally indicated by same reference numerals.

Turning now to the drawing, and in particular to FIG. 1, there is shown a longitudinal section of a balancing hoist having a housing 10 which is composed of several housing parts. At the right-hand side of FIG. 1, the housing 10 includes a hollow cylinder 11 which defines a pressure compartment 9 and is closed on one end by a cover 12 at interposition of a seal 13 for protecting the compartment 9 against ingress of dust. Fitted in the compartment 9 of the hollow cylinder 11 for displacement in longitudinal direction is a cylindrical piston 14 which is sealed against the hollow cylinder 11 by a sealing ring 15. The piston 14 is supported by a thrust bearing 16 which is received by an end face of a cable drum 17 having an outer surface with tracks 20 for receiving a wire cable 21, with one end of the cable 21 secured to the cable drum 2 and the other end of the cable 21 guided to the outside through a housing opening 21*a* and adapted for carrying a load (not shown). A fitting key 18 rigidly connects the piston-proximal end of the cable drum 17 with a threaded spindle 19 to prevent the cable drum 17 from rotating on the spindle 19.

The housing 10 is formed interiorly with a hollow cone 7 which projects inwardly from a piston-distal end of the housing 10 and terminates in a support member 7*a* for mounting therein a recirculating ball nut 19*a* in fixed rotative engagement, so that the ball nut 19*a* is securely fixed to the housing 10, with the spindle 19 rotatably supported in the ball nut 19*a*.

The piston 14, the cable drum 17 and the spindle 19 so interact with the ball nut 19*a* as to travel inside the housing 10 in longitudinal direction between two end positions during rotational movement, such that the cable 21 exits the housing 10 substantially at the same location. In FIG. 1, the upper half of the illustration shows the one end position, i.e. the left end position, in which the cable 21 is completely wound onto the cable drum 17 (highest load position), while the lower half shows the other end position, i.e. the right end position, in which the cable 21 is completely unwound (lowest load position). Displacement of the cable drum 17 is implemented by the piston 14 through introduction of gas under pressure into the compartment 9 via suitable passageways in dependence on the load carried by the cable 21 of the cable drum 17.

At operation, gas under pressure enters the compartment 9 in dependence on the load being carried, thereby urging the piston 14 to the left so that the cable drum 17 and the spindle 19 are also pushed to the left. As a consequence of the immobility of the ball nut 19*a* and the fixed rotative engagement between the spindle 19 and the cable drum 17, the cable drum 17 rotates at the same time to thereby wind up the cable 21 and to lift the load.

As shown in FIG. 1, the spindle 19 projects with its piston-distal end into a housing chamber 22 bounded by the support member 7. A cover 22*a* closes the open end of the support member 7 to protect the housing chamber 22 against ingress of dust. The piston-distal end of the spindle 19 supports a safety device to provide an emergency braking by preventing the cable drum 17 from rotating beyond a predetermined rotation speed, as will now be described in more detail with respect to FIGS. 2 and 3, in which the cover 22*a* has been removed.

Figure 4:
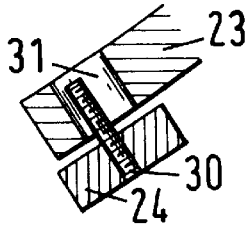
FIG. 4 is a sectional cutaway view of the safety device, taken along the line IV—IV in FIG. 2.

The safety device includes an inner cone 27 which is mounted to the piston-distal end of the spindle 19, with a fitting key 27*a* and adhesive preventing the inner cone 27 from rotating relative to the spindle 19. A disk-shaped outer cone 23 which complements the inner cone 27 is pushed over the inner cone 27 and tightened in axial direction by a washer 28 and a screw fastener 29 to thereby realize a forced rotational union between the inner cone 27 and the outer cone 23. In proximity of its periphery, the outer cone 23 has attached thereon two pawls 24, with each pawl 24 rotatable about a pivot pin 25 and extending at a slanted orientation at an angle of less than 150° in relation to the plane in which the axis of the spindle 19 and the pivot pin 25 lie. Each pawl 24 is biased by a spring 26 so as to seek a radially inward idle (ready) position, when the spindle 19 is at rest. The tension of the spring 26 can be adjusted by the screw fastener 29 to vary the transmittable torque. Pins 30 are mounted to the pawls 24 for engagement in openings 31 of the outer cone 23, as shown in FIG. 4.

Figure 3:
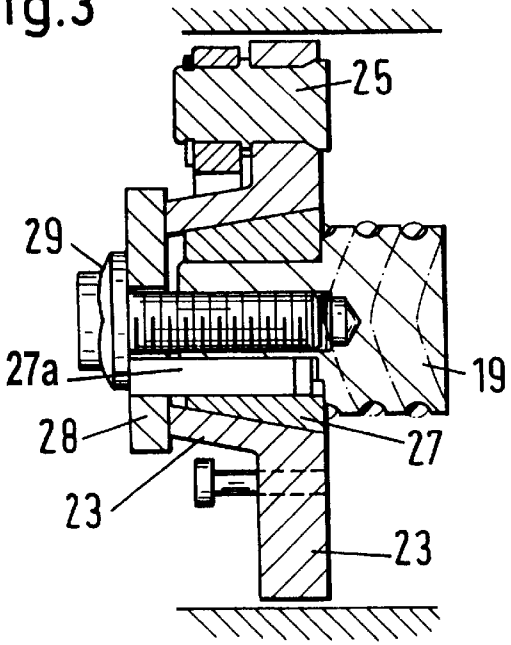
FIG. 3 is a sectional view of the safety device, taken along the line III—III in FIG. 2.

As further shown in FIG. 3, the key 27*a* projects with its washer-proximal end (left end in FIG. 3) in a recess of the washer 28 to prevent the washer 28 from rotating relative to the spindle 19.

Figure 2:
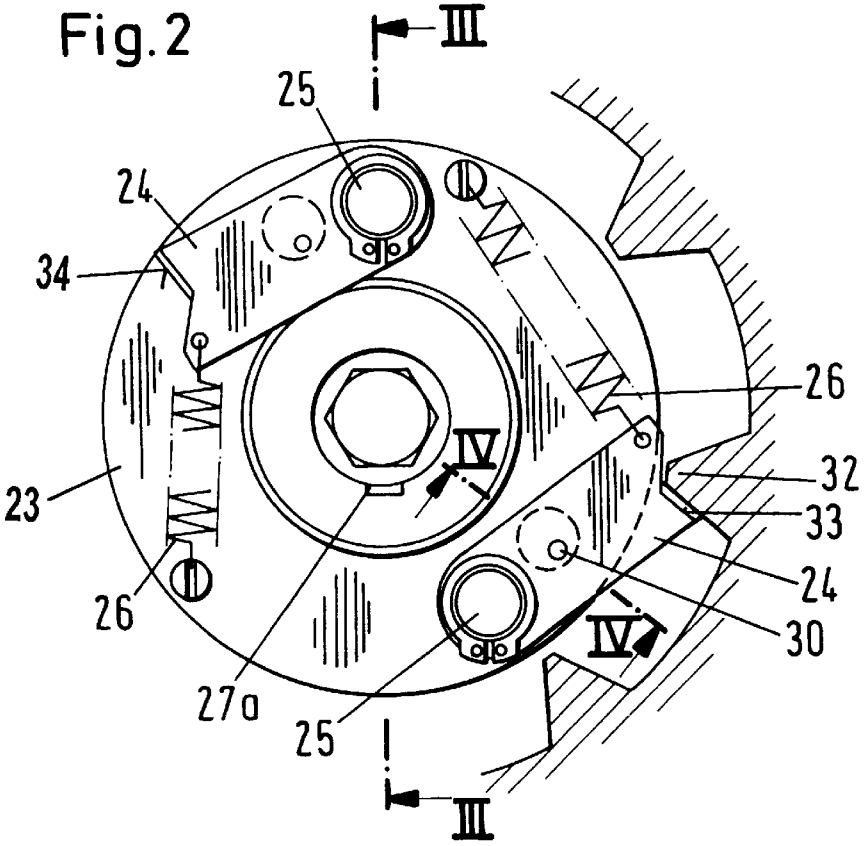
FIG. 2 is a side view of the safety device.

In rotation direction of the cable drum 17, the pawls 24 are each formed with an indentation 34 to define a brake surface 33 for interaction with cam-like enlargements which project inwardly from the housing wall and define stoppers 32, as shown in FIG. 2.

The safety device operates as follows: When the spindle 19 and thus the cable drum 17 rotate below a predetermined rotation speed, the pawls 24 are restrained in the radially inward idle position by the springs 26. As the rotation speed of the cable drum 17 increases, the pawls 24 are moved radially outwards by the centrifugal force about their pivot pins 25 in opposition to the restraining force of the springs 26. When the rotation of the cable drum 27 exceeds the predetermined rotation speed (set by the tension of the springs 26), the centrifugal force acting on the pawls 24 causes the pawls 26 to contact the stoppers 32 with their brake surfaces 33 to thereby halt the rotation of the outer cone 23 and ultimately the rotation of the spindle 19 and the cable drum 17, as a consequence of the frictional engagement between the inner cone 27 and the outer cone 23.

In view of the frictional engagement between the outer cone 23 and the inner cone 27, the rotational movement of the cable drum 17 is thus not suddenly halted but only after a certain time delay, so that dynamic forces are reduced at stoppage. The extent of delay can be adjusted by the tightening force of the screw fastener 29 and thus by the slipping moment between the inner cone 27 and the outer cone 23. The positive connection between the key 27*a* and the washer 28 prevents a change of the tightening force of the screw fastener 29 at stoppage.

As a result of the projection of the pins 30 in the openings 30 of the outer cone 23, the pivot angle of the pawls 24 is restricted, thereby ensuring that only the brake surface 33 contacts the stoppers 32, and preventing an overextension of the springs 26.

While the invention has been illustrated and described as embodied in a device for limiting the upper rotation speed of a balancing hoist, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A balancing hoist, comprising:

a housing having a chamber accessible from outside;

a piston movable by gas pressure in the housing in a longitudinal direction;

a threaded spindle caused to rotate as the piston moves in the longitudinal direction, said spindle carrying a nut which is securely fixed to the housing;

a cable drum mounted in fixed rotative engagement to the spindle and movable longitudinally along the spindle;

at least one pawl configured for rotation in opposition to an elastic restraining force between a radially inward idle position and a radially outward brake position about a pivot pin, which extends in parallel relationship to the spindle, said pawl pointing in rotation direction at rotating cable drum and pivoting into the brake position as a result of centrifugal forces, when a rotation speed of the cable drum exceeds a predetermined level which is dependent on the magnitude of the restraining force; and at least one fixed stopper projecting radially inwardly from the housing at a level with the brake position for interaction with the pawl, when the pawl is in the brake position, for braking the rotation of the cable drum until its standstill, wherein the spindle has one end projecting into the chamber of the housing for connection to the pivot pin.

2. The balancing hoist of claim 1, wherein the housing has a housing wall, said stopper configured as an enlargement of the housing wall and projecting inwardly into the chamber.

3. The balancing hoist of claim 1, and further comprising an inner cone fixedly secured to the spindle, and a complementary outer cone placed over the inner cone, said pivot pin mounted to the outer cone.

4. The balancing hoist of claim 3, and further comprising means for bracing the inner cone against the outer cone in axial direction.

5. The balancing hoist of claim 4, wherein the pawl rotates about a pivot angle, said pawl having means to limit the rotation about the pivot angle.

6. The balancing hoist of claim 1, wherein the pawl has an indentation to form a brake surface and destined for impact upon the stopper.

7. The balancing hoist of claim 1, wherein the spindle defines an axis, said axis and said pivot pin extending in a plane, said pawl defined by a longitudinal axis which extends in relation to the plane at an angle of less than 150°.

8. A balancing hoist, comprising:

a housing having a chamber accessible from outside;

a cable drum rotatably supported in the housing;

a piston movable by gas pressure in the housing in a longitudinal direction;

a threaded spindle caused to rotate as the piston moves in the longitudinal direction, said spindle carrying a nut which is securely fixed to the housing, said cable drum being mounted in fixed rotative engagement to the spindle and movable longitudinally along the spindle; and a braking mechanism, mounted in the chamber to a piston-distal end of the spindle, for gradually halting the rotation of the cable drum when exceeding a predetermined rotation speed, wherein the braking mechanism includes an outer cone which is in frictional engagement with spindle.

9. The balancing hoist of claim 8, wherein the braking mechanism includes at least one spring-biased pawl swingably mounted to the outer cone for rotation between a radially inward idle position, which the pawl maintains so long as the cable drum rotates below the predetermined rotation speed, and a radially outward brake position, which the pawl occupies as a result of centrifugal forces when the cable drum exceeds the predetermined rotation speed.

10. The balancing hoist of claim 9, wherein the pawl is acted upon by a spring applying a restraining force which is determinative for the magnitude of the predetermined rotation speed.

11. The balancing hoist of claim 9, wherein the braking mechanism includes a stationary stopper projecting radially inwardly from the housing for impact by the pawl, when the pawl is in the brake position.

12. The balancing hoist of claim 8, wherein the braking mechanism includes an inner cone fixedly secured to the spindle, said outer cone placed over the inner cone with their confronting surfaces forming friction surfaces.

13. The balancing hoist of claim 12, wherein the braking mechanism includes fastening means for bracing the inner cone against the outer cone in axial direction.

14. The balancing hoist of claim 13, wherein the pawl rotates about a pivot angle, said pawl having restriction means to limit the rotation about the pivot angle.

15. The balancing hoist of claim 14, wherein the restriction means includes a pin secured to the pawl for engagement in an opening of the outer cone.

16. The balancing hoist of claim 8, wherein the chamber of the housing is accessible through an axial opening of the housing, and further comprising a detachable cover for closing the opening.

17. A safety device for a balancing hoist having a spindle for rotating a cable drum, said safety device comprising a braking mechanism, mounted to one end of the spindle, for gradually halting the rotation of the cable drum when exceeding a predetermined rotation speed, wherein the braking mechanism includes an outer cone which is in frictional engagement with spindle.

18. The safety device of claim 17, wherein the braking mechanism includes at least one spring-biased pawl swingably mounted to the outer cone for rotation between a radially inward idle position, which the pawl maintains so long as the cable drum rotates below the predetermined rotation speed, and a radially outward brake position, which the pawl occupies as a result of centrifugal forces when the cable drum exceeds the predetermined rotation speed.

19. The safety device of claim 18, wherein the pawl is acted upon by a spring applying a restraining force which is determinative for the magnitude of the predetermined rotation speed.

20. The safety device of claim 18, wherein the pawl strikes against a stationary stopper, when the pawl is in the brake position.

21. The safety device of claim 17, wherein the braking mechanism includes an inner cone fixedly secured to the spindle, said outer cone placed over the inner cone with their confronting surfaces forming friction surfaces.

22. The safety device of claim 21, wherein the braking mechanism includes fastening means for bracing the inner cone against the outer cone in axial direction.

23. The safety device of claim 22, wherein the pawl rotates about a pivot angle, said pawl having restriction means to limit the rotation about the pivot angle.

24. The safety device of claim 23, wherein the restriction means includes a pin secured to the pawl for engagement in an opening of the outer cone.

* * * * *

UNITED STATES PATENT AND TRADEMARK OFFICE

CERTIFICATE OF CORRECTION

PATENT NO. : 6,578,822 B2
DATED : June 17, 2003
INVENTOR(S) : Heun et al.

It is certified that error appears in the above-identified patent and that said Letters Patent is hereby corrected as shown below:

Title page,
Item [75], Inventors should read as follows:

[75] -- Jürgen Heun, Dortmund (DE);
Markus Löbel, Witten (De);
Klaus-Jürgen Winter, Wetter (DE);
Harald Spies, Wetter (DE) --

Signed and Sealed this

Twenty-third Day of December, 2003

JAMES E. ROGAN
*Director of the United States Patent and Trademark Office*